US012275908B2

(12) United States Patent
Lee

(10) Patent No.: US 12,275,908 B2
(45) **Date of Patent: *Apr. 15, 2025**

(54) EMULSIFICATION METHOD OF FUEL OIL AND DESULFURIZER FOR SULFUR OXIDE REDUCTION

(71) Applicant: LOWCARBON CO., LTD., Jeollanam-do (KR)

(72) Inventor: Cheol Lee, Cheongju-si (KR)

(73) Assignee: LOWCARBON CO., LTD, Jeollanam-do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/758,690

(22) PCT Filed: Jul. 5, 2021

(86) PCT No.: PCT/KR2021/008478

§ 371 (c)(1),
(2) Date: Jul. 12, 2022

(87) PCT Pub. No.: WO2023/282360

PCT Pub. Date: Jan. 12, 2023

(65) Prior Publication Data

US 2024/0166965 A1 May 23, 2024

(51) Int. Cl.
*C10L 1/32* (2006.01)

(52) U.S. Cl.
CPC ..... *C10L 1/328* (2013.01); *C10L 2290/145* (2013.01); *C10L 2290/24* (2013.01); *C10L 2290/40* (2013.01)

(58) Field of Classification Search
CPC ..... C10L 1/328; C10L 2290/40; C10L 2290/145; C10L 2290/24; C10G 29/00;
(Continued)

(56) References Cited

U.S. PATENT DOCUMENTS 9,795,938 B2 10/2017 Abo-Hammour
2010/0236134 A1* 9/2010 Mogami ..... B01F 25/422 261/18.2
2014/0305028 A1* 10/2014 Koh ..... B01J 19/087 44/639

FOREIGN PATENT DOCUMENTS

KR 10-2000-004849 A 1/2000
KR 10-2000-005631 A 1/2000
(Continued)

OTHER PUBLICATIONS

International Search Report for International application No. PCT/KR2021/008478, Apr. 1, 2022, ISA/KR.

*Primary Examiner* — Vishal V Vasisth
(74) *Attorney, Agent, or Firm* — ArentFox Schiff LLP; Yun Choe

(57) ABSTRACT

Proposed is a method of emulsifying fuel oil and a desulfurization agent. The method includes (a) a step of adding a desulfurization agent to fuel oil for line mixing thereof, (b) a step of generating droplets in the resulting mixture of step (a), (c) a step of causing the resulting mixture of step (b) to pass through a magnetic field so that the mixture can be magnetized, (d) a step of subjecting the resulting mixture of step (c) to vortex mixing, and (e) a step of causing collision of the resulting mixture of step (d). The method uses fuel oil as a continuous phase and a water-based desulfurization agent as a disperse phase and emulsifies the desulfurization agent in the fuel oil through water-in-oil (W/o) emulsification so that the desulfurization agent can be stably dispersed in the fuel oil. Since the fuel oil and the desulfurization agent are burned together during combustion, sulfur oxides that may occur during the combustion are removed, whereby sulfur oxide emissions are reduced.

9 Claims, 4 Drawing Sheets

(58) Field of Classification Search
CPC ..... C10G 32/02; C10G 29/16; B10F 23/803; B10F 25/25; B10F 25/1042; B10F 23/2323; B10F 25/3141; B10F 25/4521; B10F 23/411; B10F 33/821; B10F 25/103; B10F 25/43141
See application file for complete search history.

(56) References Cited

FOREIGN PATENT DOCUMENTS

| | | | |
|---|---|---|---|
| KR | 10-2008-0032931 | A | 4/2008 |
| WO | 2018-073018 | A1 | 4/2018 |

* cited by examiner (a)

(b)

EMULSIFICATION METHOD OF FUEL OIL AND DESULFURIZER FOR SULFUR OXIDE REDUCTION

CROSS-REFERENCE TO RELATED APPLICATION

This application is a 371 U.S. national stage of PCT/KR2021/008478, filed Jul. 5, 2021, the contents of which are incorporated herein by reference.

TECHNICAL FIELD

The present invention relates to a method of emulsifying fuel oil and a desulfurization agent for reducing sulfur oxides. More particularly, the present invention relates to a method of emulsifying fuel oil and a desulfurization agent for reducing sulfur oxides, the method mixing a desulfurization agent with fuel oil such as bunker C oil to emulsify the mixture, thereby reducing sulfur oxides ($SO_x$) emissions during fuel combustion.

BACKGROUND ART

Sulfur oxides ($SO_x$) and nitrogen oxides ($NO_x$) are pointed out as pollutants that cause air pollution. In particular, sulfur oxides are contained in industrial flue gas emitted during the combustion of fossil fuels containing sulfur, and the sulfur oxides cause various environmental pollution problems such as acid rain.

Desulfurization technology for removing sulfur oxides from industrial flue gas has been continuously studied, and a flue gas desulfurization method of treating flue gas after combustion of fossil fuels has been generally used in factories or power plants.

The flue gas desulfurization method refers to a method of desulfurizing the flue gas after burning a fossil fuels containing sulfur, and the flue gas desulfurization methods are categorized into wet treatment and dry treatment. A wet treatment method removes sulfur oxides by washing flue gas with ammonia water, sodium hydroxide solution, lime milk, etc. while a dry treatment method removes sulfur oxides by brining particles or powders of activated carbon or carbonates into contact with flue gas to adsorb or react with sulfur dioxide.

In particular, the sulfur oxide content of heavy fuel oil (MGO, MDO, or DDO) such as bunker C oil used in marine engines is 1,000 to 3,000 times higher than that of automobile fuel. The amount of sulfur oxides emitted by ships around the world is 130 times higher than that by automobiles and thus is called high sulfur fuel oil (HSFO) and known as the main cause of environmental pollution.

For this reason, conventionally, flue gas desulfurization, which is a post-treatment process performed after combustion of fuel, is used. The fuel gas desulfurization uses a marine wet desulfurization system to remove sulfur oxides emitted from marine engines. In the wet desulfurization system, a pump is used to supply washing water (e.g., NaOH), which is usually, to a scrubber through a cooler, and the washing water comes into contact with flue gas in the scrubber. In this case, sulfur oxides are removed through a post-treatment process.

In this case, to maintain or boost the sulfur oxide removal capability of the wet desulfurization system at or to a predetermined level, the pH of the washing water is monitored, and the supply amount of the washing water is automatically controlled. To recycle the washing water, the used washing water is purified, and a huge amount of sludge is generated during the purification of the washing water. The sludge is usually collected and stored in a sludge tank during sailing, and the sludge is treated after the ship is anchored.

The conventional wet desulfurization technique, which is a pose-treatment process, requires a lot of labor and operation cost due to the complicated washing water purification process, and it is necessary to construct an additional complex desulfurization facility. Therefore, it is difficult to apply such a conventional desulfurization system to currently operating ships. In other words, it is not easy or practical to use the conventional desulfurization system in an existing ship in terms of space and cost.

Therefore, in order to dramatically reduce the environmental pollution caused by the combustion of marine fuel oil and by the emission of sulfur oxides, research on an effective desulfurization method that can significantly reduce the emission of sulfur oxides, can easily remove sulfur oxides, and can be easily applied to an existing ship is urgently needed.

DISCLOSURE

Technical Problem

The present invention has been devised to solve the above problems, and an objective of the present invention is to provide a method of emulsifying fuel oil and a desulfurization agent. The method emulsifies a water-based desulfurization agent in fuel oil, which is oil, so that the desulfurization agent in the fuel oil is stably dispersed. As a result, the fuel oil and the desulfurization agent are burned together during fuel combustion so that sulfur oxides that are likely to occur during the fuel combustion can be removed. This reduces sulfur oxide emissions into the air.

Technical Solution

In order to solve the technical problem, the present invention provides a method of emulsifying fuel oil and a desulfurization agent, the method including: (a) a line mixing step of adding a desulfurization agent to fuel oil; (b) a droplet generation step of generating droplets from the mixture obtained in step (a); (c) a magnetization step of magnetizing the mixture by causing the mixture to pass through a magnetic field; (d) a vortex mixing step of subjecting the magnetized mixture obtained in step (c) to vortex mixing; and (e) a collision step of causing collision of the mixture obtained in step (d).

In step (a), the desulfurization agent may be contained in an amount of 3 to 10 parts by weight per 100 parts by weight of the fuel oil.

In step (b), gas may be additionally supplied.

The gas may be air or oxygen ($O_2$).

The gas may form bubbles with a size of 1 to 500 micrometers (μm) in the fuel oil.

The method may further include a gas separation step of separating the gas contained in the desulfurization agent and the fuel oil between step (d) and step (e).

In step (b), the droplets may be generated by passing the mixture of the fuel oil and the desulfurization agent through a droplet atomization unit provided with a plurality of fine holes.

The magnetic field of step (c) may have a magnetic flux density of 9,000 to 15,000 gauss.

The magnetic field of step (c) may be formed to be perpendicular to a fluid flow direction.

In step (e), the collision may occur at an angle of 15° with respect to an ejection direction of step (d).

Advantageous Effects

The fuel oil and desulfurization agent emulsification method according to the present invention uses fuel oil, which is oil, as a continuous phase, and a water-based desulfurization agent as a disperse phase and emulsifies the desulfurization agent in the fuel oil through water-in-oil (W/O) emulsification so that the desulfurization agent can be stably dispersed in the fuel oil. Since the fuel oil and the desulfurization agent are burned together during combustion, sulfur oxides that may occur during the combustion are removed whereby sulfur oxide emissions are reduced.

With the use of the fuel oil and desulfurization agent emulsification method according to the present invention, unlike a conventional desulfurization method in which exhaust gas is desulfurized after combustion of fuel, the fuel oil and the desulfurization agent are emulsified together before the fuel oil is combusted so that the fuel oil and the desulfurization agent are burned together in a marine engine. Therefore, existing marine engines can be used without requiring construction of an additional desulfurization facility. Therefore, the fuel oil and desulfurization agent emulsification method according to the present invention can be simply and easily applied to existing marine engines and has a high desulfurization effect.

BEST MODE

Prior to describing preferred embodiments of the present invention, it should be noted that the terms and words used in the present specification and the appended claims should not be construed as limited to conventional or dictionary meanings but should be construed as meaning and concept consistent with the technical idea of the present invention.

It will be further understood that the terms "comprises" and/or "comprising", or "includes" and/or "including", or "has" and/or "having", when used in this specification, specify the presence of stated features, regions, integers, steps, operations, elements, and/or components, but do not preclude the presence or addition of one or more other features, regions, integers, steps, operations, elements, and/or components.

Hereinafter, a fuel oil and desulfurization agent emulsification method of the present invention will be described in more detail.

Figure 1:
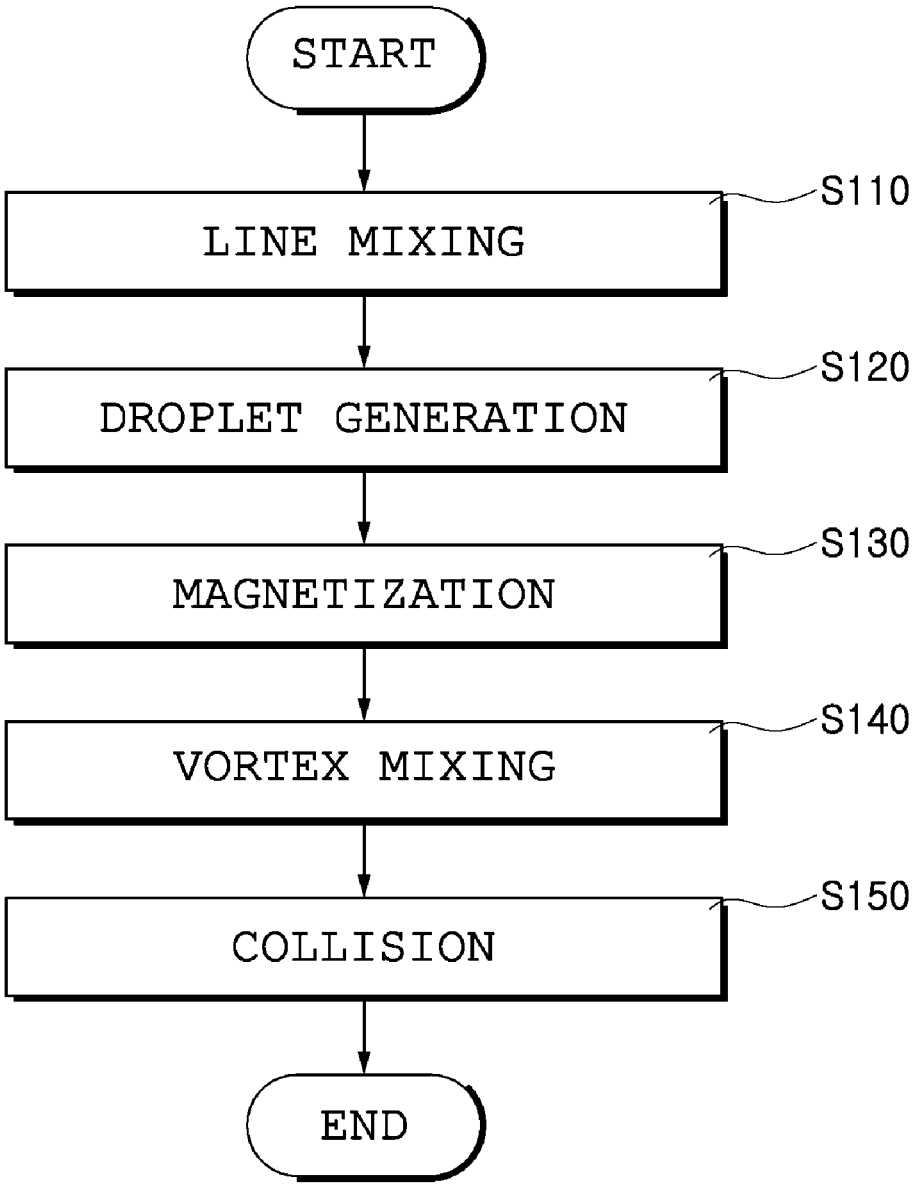
FIG. 1 is a process flow chart illustrating a fuel oil and desulfurization agent emulsification method according to the present invention.

FIG. 1 is a process flow chart illustrating a fuel oil and desulfurization agent emulsification method according to the present invention. Referring to FIG. 1, the emulsification method includes: (a) a line mixing step of adding a desulfurization agent to fuel oil; (b) a droplet generation step of generating droplets from a mixture obtained in step (a); (c) a magnetization step of magnetizing the mixture by causing the mixture to pass through a magnetic field; (d) a vortex mixing step of subjecting the magnetized mixture obtained in step (c) to vortex mixing; and (e) a collision step of causing collision of the mixture obtained in step (d).

Step (a) is step S110 for line mixing of fuel oil and a desulfurization agent by adding the desulfurization agent to the fuel oil.

In this step, for water-in-oil (W/O) emulsification by supplying a water-based desulfurization agent to fuel oil, which is oil, the fuel oil and the desulfurization agent are supplied to a line mixer so that the fuel oil and the desulfurization agent are mixed through line mixing.

A liquid phase in which the fuel oil and the desulfurization agent used in the present invention are mixed is collectively referred to as a "mixture".

Figure 2:
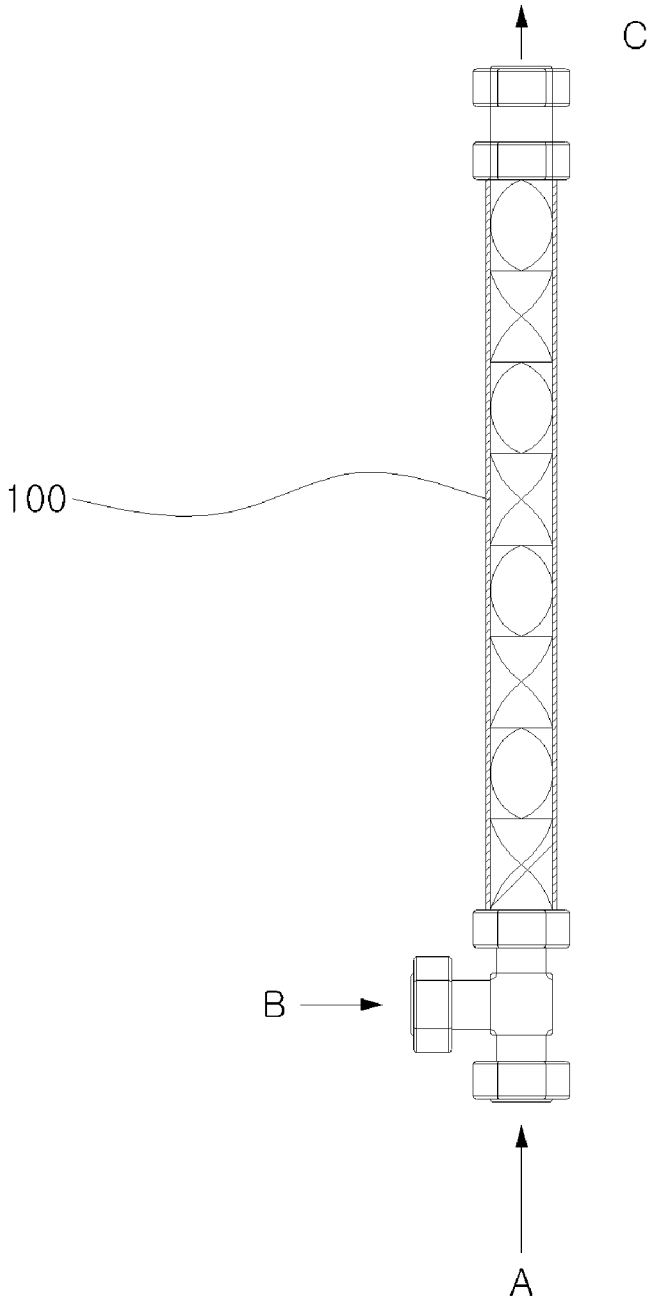
FIG. 2 is a plan view of a line mixer used in step (a) according to an embodiment of the present invention.

FIG. 2 is a perspective view of a line mixer used in step (a) according to one embodiment of the present invention.

Referring to FIG. 2, the fuel oil is fed into a line mixer 100 through a portion denoted by A, and the desulfurization agent is fed into the line mixer through a portion denoted by B. The fuel oil and the desulfurization agent introduced into the line mixer are well mixed through line mixing, and the mixture of the fuel oil and the desulfurization agent flows out of the line mixer through a portion denoted by C.

In this step, the fuel oil is a collective term for fuel such as gasoline, kerosene, diesel, or heavy oil. In one embodiment of the present invention, bunker C oil, which is high sulfur oil, is used as the fuel oil, but the fuel oil is not limited thereto.

In this step, while the fuel oil is supplied at a constant flow rate, 3 to 10 parts by weight of the desulfurization agent is supplied per 100 parts by weight of the fuel oil, and they are mixed.

When the supply of the desulfurization agent is less than 3 parts by weight per 100 parts by weight of the fuel oil, since the amount of the desulfurization agent dispersed in the fuel oil is not significant, the desulfurization effect is not sufficient. On the other hand, when the supply of the desulfurization agent exceeds 10 parts by weight per 100 parts by weight of the fuel oil, there is a problem in that the combustion efficiency of the emulsion of fuel oil and desulfurization agent is reduced.

As the desulfurization agent, a liquid catalyst that can remove sulfur oxides ($SO_x$) generated during combustion of fuel oil may be used.

In the present invention, the desulfurization agent includes at least one oxide selected from the group consisting of $SiO_2$, $Al_2O_3$, $Fe_2O_3$, $TiO_2$, MgO, MnO, CaO, $Na_2O$, $K_2O$, and $P_2O_3$. Preferably, the desulfurization agent includes all of $SiO_2$, $Al_2O_3$, $Fe_2O_3$, $TiO_2$, MgO, MnO, CaO, $Na_2O$, $K_2O$, and $P_2O_3$.

When $SiO_2$, $Al_2O_3$, $Fe_2O_3$, $TiO_2$, MgO, MnO, CaO, $Na_2O$, $K_2O$, and $P_2O_3$ are all included, the basic formula of the desulfurization agent becomes $K_{0.8\text{-}0.9}(Al,Fe,Mg)_2(Si,Al)_4O_{10}(OH)_2$ which is a mineral commonly called illite. The illite has a 2:1 structure in which one octahedral layer is bonded between two tetrahedral layers. The octahedral layer has a dioctahedral structure in which only 2 cation sites out of 3 cation sites in the bonding structure are filled with cations. Due to the lack of cations, the illite is overall negatively charged (−). For this reason, sulfur oxides ($SO_x$) can be adsorbed when the mixture of the fuel oil and the desulfurization catalyst is burned.

In this step, the oxides contained in the desulfurization agent include 15 to 90 parts by weight of $SiO_2$, 15 to 100 parts by weight of $Al_2O$, 10 to 50 parts by weight of $Fe_2O_3$, 5 to 15 parts by weight of $TiO_2$, 20 to 150 parts by weight of MgO, 10 to 20 parts by weight of MnO, and 20 to 200 parts by weight of CaO, 15 to 45 parts by weight of $Na_2O$, 20 to 50 parts by weight of $K_2O$, and 5 to 20 parts by weight of $P_2O_3$.

In addition, the oxides may be mixed and pulverized into fine particles having a particle size of 1 to 2 μm by a pulverizer before being prepared as the desulfurization agent. The oxides may have a specific gravity of 2.5 to 3.0 and may be in the form of powder that is streak-colored or silvery white.

The desulfurization agent according to the present invention may include one or more metals selected from the group consisting of Li, Cr, Co, Ni, Cu, Zn, Ga, Sr, Cd, and Pb. As in one embodiment, all of the metals including Li, Cr, Co, Ni, Cu, Zn, Ga, Sr, Cd, and Pb are preferably included.

As the metals, the desulfurization agent may include 0.0035 to 0.009 parts by weight of Li, 0.005 to 0.01 parts by weight of Cr, 0.001 to 0.005 parts by weight of Co, 0.006 to 0.015 parts by weight of Ni, 0.018 to 0.03 parts by weight of Cu, 0.035 to 0.05 parts by weight of Zn, 0.04 to 0.08 parts by weight of Ga, 0.02 to 0.05 parts by weight of Sr, 0.002 to 0.01 parts by weight of Cd, and 0.003 to 0.005 parts by weight of Pb.

In addition, the metals, like the oxides, may be mixed and pulverized into fine particles having a particle size of 1 to 2 μm by a pulverizer, the metals may have a specific gravity of 2.5 to 3.0, and the metals may be in the form of powder that is streak-colored and silvery white.

The desulfurization agent may include at least one liquid composition selected from the group consisting of sodium tetraborate ($Na_2B_4O_7 \cdot 10H_2O$), sodium hydroxide (NaOH), sodium silicate ($Na_2SiO_3$) and hydrogen peroxide ($H_2O_2$). As a solvent, water ($H_2O$) may be used. Preferably, all the liquid compositions including sodium tetraborate, sodium hydroxide, sodium silicate and hydrogen peroxide are preferably used.

The desulfurization agent according to the present invention forms a metal chelate compound through coordination with the metals because the oxides and the liquid compositions are mixed and reacted to serve as a chelating agent.

In addition, the liquid composition may be adsorbed on ash generated when a combustible material is combusted so that the liquid composition may react with sulfur oxides present in the ash, thereby removing the sulfur oxides. $NaBO_2$ is derived from the sodium tetraborate ($Na_2B_4O_7$), $NaBH_4$ is produced through hydrogenation, and the produced $NaBH_4$ reacts with oxygen and sulfur oxides to form sodium sulfate ($Na_2SO_4$). Thus, the sulfur oxides are removed. The reactions are represented by Reaction Formulas 1 and 2 below.

$$NaBH_4+O_3 \rightarrow Na_2O_2+H_2O+B \quad \text{[Reaction Formula 1]}$$

$$1)\ Na_2O_2+SO_3 \rightarrow Na_2SO_4+O$$

$$2)\ Na_2O_2+SO_2 \rightarrow Na_2SO_4$$

$$3)\ Na_2O_2+SO \rightarrow Na_2SO_3 \quad \text{[Reaction Formula 2]}$$

In addition, as the liquid compositions, the sodium tetraborate, the sodium hydroxide, the sodium silicate, and the hydrogen peroxide may be included in amounts of 20 to 130 parts by weight, 15 to 120 parts by weight, 50 to 250 parts by weight, and 10 to 50 parts by weight, respectively in the desulfurization agent.

When the desulfurization agent according to the present invention is mixed with a combustible material and combusted together at a temperature in a range of 400° C. to 1200° C., the effect of adsorbing sulfur oxides can be activated. However, when the mixture is combusted in a temperature range of 600° C. to 900° C., high efficiency can be obtained.

Step (b) is step S120 in which droplets of the mixture obtained in step (a) are generated.

In this step, emulsification is carried out by dispersing the desulfurization agent in the fuel oil by generating droplets for W/O emulsification of the fuel oil and desulfurization agent present in the mixture.

The droplets of the mixture can be generated by various known methods in this step, but preferably a homogenizer may be used for the generation of the droplets of the mixture.

In addition, as a method of generating droplets of the mixture in this step, a method of passing a droplet atomization unit through a transfer pipe for transporting the mixture.

The droplet atomization unit refers to a unit that forms droplets by applying pressure or shear force to the mixture. In one embodiment, the droplet atomization unit is configured such that a plate with the same diameter as the inner diameter of the transfer pipe for transporting the mixture obtained in step (a) is prepared and fixed, and a plurality of fine holes are formed in the plate.

The mixture in the transfer pipe is conveyed by a transferring pump, and the mixture is pressed against the droplet atomization unit. The mixture impeded in movement by the droplet atomization unit is finely dispersed while passing through the fine holes formed in the droplet atomization unit due to the shear force and pressure, thereby forming droplets.

The hole diameter of the droplet atomization unit used in one embodiment may range from 1 to 500 μm. When the diameter is smaller than 1 μm, there is a problem in that the overall process proceeds slowly because the amount of the mixture that passes through the droplet atomization unit is small and thus the number of generated droplets is small. On the other hand, when the diameter is larger than 500 μm, there is a problem in that the droplet formation effect is deteriorated.

In addition, in this step, gas may be further supplied and mixed.

In this step, the gas supplied during the droplet generation of the mixture forms air bubbles in the mixture. The air bubbles are repeatedly formed and broken and influences the surface tension of the fuel oil and the desulfurization agent, thereby facilitating droplet formation.

In this step, the gas may be supplied before, during, or after the mixture passes through the droplet atomization unit. The gas may be supplied dependently or independently of each step.

As the gas supplied in this step, various known gases can be used. However, as the gas supplied in the present invention, air or oxygen ($O_2$) may be used to help emulsify the fuel oil and the desulfurization agent and to enable complete combustion during the subsequent combustion.

The gas may form bubbles having a size of 1 to 500 μm in the fuel oil. When bubbles having a size smaller than 1 μm are formed, air bubbles are not well formed in the mixture. When bubbles having a size larger than 500 μm are formed, the bubbles are easily destroyed and easily escape to the outside because the stability of the bubbles is low.

Step (c) is step S130 in which the mixture with droplets generated in step (b) passes through a magnetic field so that the droplets are magnetized.

This step is a step of magnetizing the mixture passing through the pipe by causing the mixture to pass the magnetic field by forming a magnetic field by placing a permanent magnet around the pipeline through which the mixture with the droplets generated in step (b) flows.

Because the fuel oil is hydrophobic and the desulfurization agent is hydrophilic, the mixture that has passed through the magnetic field has electrical charges or magnetic moments due to magnetic force. Therefore, the dispersion effect to form an emulsion is maximized.

The magnetic field used in this step has a magnetic flux density of 9,000 and 15,000 gauss. When the magnetic flux density does not fall within the range, the formation of electric charges or magnetic moments in the mixture does not occur or weakly occurs. Thus, the dispersion effect is deteriorated.

In addition, the magnetic field in this step can be formed using a variety of known methods that can form a magnetic field. For example, a magnet or an electromagnet may be used. Preferably, a permanent magnet is used and at least one permanent magnet may be installed on each pipeline.

The direction of the magnetic field may be the same as the flow direction of the mixture, or the direction of the magnetic field may be perpendicular to the flow direction of the mixture.

Step (d) is vortex mixing step S140 in which the magnetized mixture is mixed through vortex mixing.

In this step, the magnetized mixture obtained in step (c) is pushed and swirled by the pumping force of a pump so that the fuel oil and the desulfurization agent can be vigorously mixed to be well dispersed.

In this step, the mixture may be introduced into a vessel with a circular or oval-shaped internal space so that the mixture can be easily swirly and mixed.

In addition, the vortex mixing allows the fuel oil and desulfurization agent to be better dispersed when the mixture is introduced into a vortex mixer composed of multi-stage cylinders having different sizes and is swirled therein.

Figure 3:
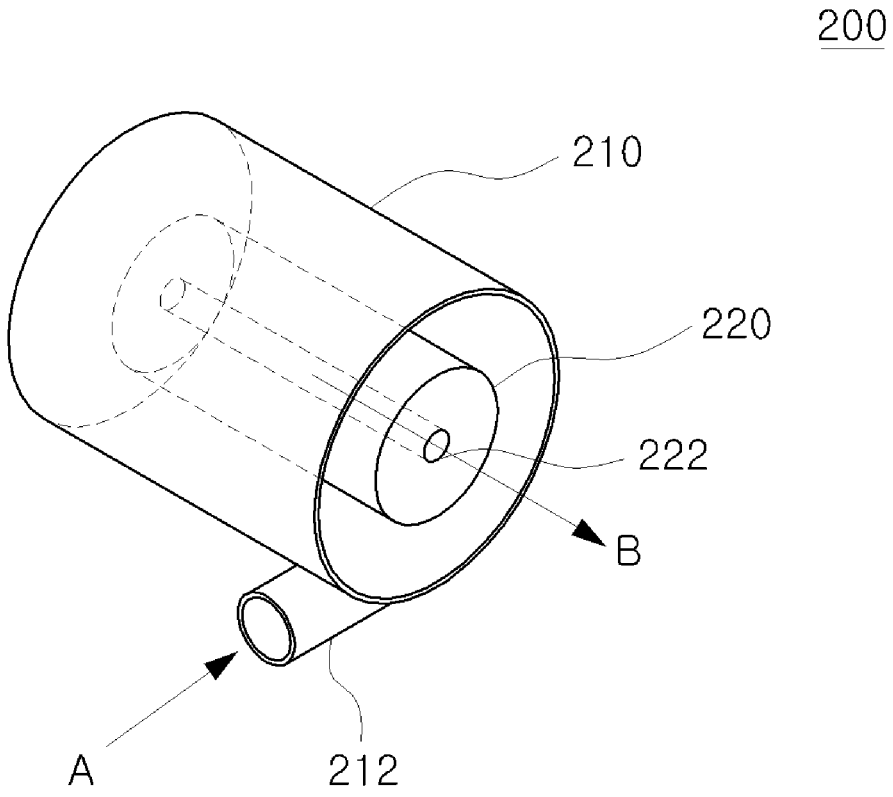
FIG. 3 is a perspective view of a vortex mixer used in step (*c*) according one embodiment of the present invention.

FIG. 3 is a perspective view illustrating an embodiment of a vortex mixer 200 used in this step. Referring to FIG. 3, the vortex mixer 200 includes an outer cylinder 210 and an inner cylinder 220. A first side of the outer cylinder 210 is provided with an inlet 212 through which the mixture is introduced, and a center portion of the inner cylinder 220 is provided with an outlet 222 through which the mixture is ejected.

When the first side in which the inlet 212 is formed is assumed to be the upper surface of the inner cylinder 220, the upper surface of the inner cylinder 220 is formed to be flush with the upper surface of the outer cylinder 210, and the lower surface of the inner cylinder 220 is spaced from the lower surface of the outer cylinder 210 so that a predetermined space is formed between the lower surface of the inner cylinder 220 and the lower surface of the outer cylinder 210.

The vortex mixing performed in this step will be further detailed below. The mixture magnetized in step (c) is introduced into the vortex mixer through the inlet 212 under the static pressure of the pump (see arrow A in FIG. 3), and the mixture is vigorously mixed while performing dynamic swirling with a strong rotational force in the space formed between the inner cylinder 220 and the outer cylinder 210.

The mixture swirled several times under pressure is discharged to the outside (see arrow B in FIG. 3) through the outlet 222 formed in the lower surface of the inner cylinder 220.

In the present invention, after step (d) is completed, a gas separation step of separating the gas contained in the mixture in which the desulfurization agent and fuel oil are mixed may be further performed.

In one embodiment, in the gas separation step, the mixture of step (d) may be charged into and pressurized in a compressible chamber. The gas present in the mixture may be separated as a liquid mixture by the pressure applied thereto. Specifically, the gas may be separated as the fuel oil and the desulfurization agent.

The separated liquid (mixture) undergoes the following step (i.e., collision step S150) corresponding to step (e) to be below.

Step (e) is step S150 in which impact is applied to the mixture obtained in step (d).

In this step, the mixture discharged through the outlet 222 of the vortex mixer 100 of step (d) is ejected by an ejector such as a sprayer so that the mixture can strongly collide with a structure such as a wall or pipe to form finer droplets.

In step (d), the mixture having undergone the vortex mixing in step (d) is made to collide with a structure such as a wall or pipe so that finer droplets can be formed in the mixture. Due to this step, the mixture can be well dispersed, and the emulsified state can be maintained for a long time.

For the collision of the mixture in this step, various known structures such as walls or pipes can be used. The mixture may collide at any angle but preferably collides at an angle of 15° with respect to the flow direction in which the mixture is ejected.

The emulsification method of the present invention can be carried out only once or several times, depending on the condition.

In addition, the emulsification method of the present invention is applicable to all fuel oils that are used for combustion, such as fuel oil for ships, fuel oil for vehicles, and fuel oil for power generation.

Figure 4:
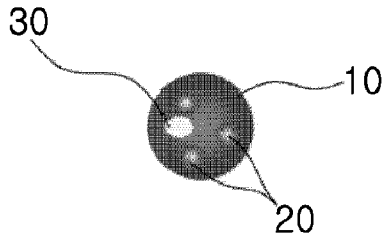
FIG. 4 is a conceptual diagram illustrating a process of burning an emulsion containing fuel oil and a desulfurization agent, according to an embodiment of the present invention.
Figure 4:
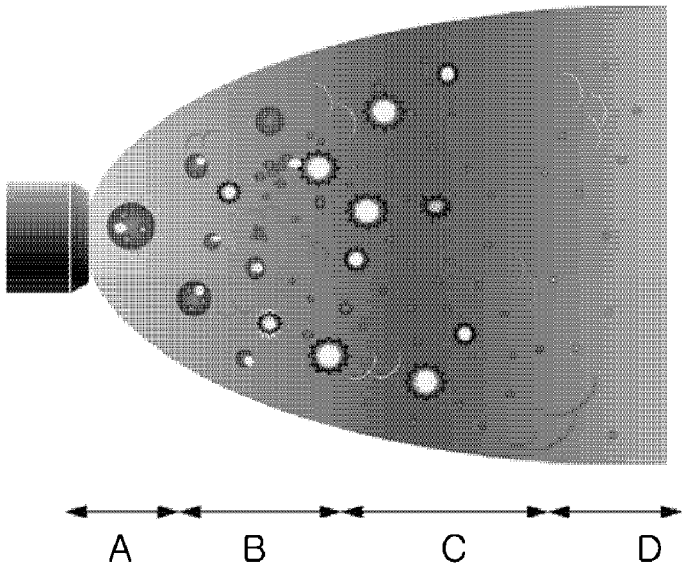

FIG. 4 is a conceptual diagram illustrating a process of burning an emulsion containing fuel oil, a desulfurization agent, and gas, according to an embodiment of the present invention.

(a) in FIG. 4 illustrates a state when a mixture containing emulsified fuel oil, desulfurization agent, and gas is ejected according to an embodiment of the present invention. When ejected, a desulfurization agent 20 and a gas 30 emulsified as droplets are contained in fuel oil 10.

(b) in FIG. 4 is a conceptual diagram illustrating a process in which when the emulsified mixture of the fuel oil, the desulfurization agent, and the gas is ejected, the emulsified mixture is burned, and desulfurization is performed.

Referring to (b) in FIG. 4, stage A in (b) of FIG. 4 is an ejection step of ejecting the mixture in which the fuel oil, the desulfurization agent, and the gas are emulsified. The ejected mixture is combusted by heat in stage B, the mixture is destroyed in stage C, and the fuel oil and oxygen which is the gas contained in the mixture are burned together. In this case, complete combustion occurs.

In stage D, sulfur oxides in the burned fuel oil are removed by the desulfurization agent serving as a catalyst.

The fuel oil and desulfurization agent emulsification method according to the present invention is devised to solve the problems of existing desulfurization methods, including complicated processes, costly labor and operation, and the necessity of construction of an additional desulfurization facility with a complicated structure. The emulsification method of the present invention uses fuel oil as a continuous phase and a water-based desulfurization agent as a disperse phase and emulsifies the desulfurization agent in the fuel oil through water-in-oil (W/O) emulsification so that the desulfurization agent can be stably dispersed in the fuel oil. Since the fuel oil and the desulfurization agent are burned together during combustion, sulfur oxides that may occur during the combustion are removed whereby sulfur oxide emissions are reduced.

With the use of the fuel oil and desulfurization agent emulsification method according to the present invention, unlike conventional desulfurization methods in which exhaust gas is desulfurized after combustion of fuel, fuel oil and a desulfurization agent are emulsified together before the fuel oil is combusted so that the fuel oil and the desulfurization agent can be burned together in a marine engine. Therefore, existing marine engines can be used without requiring construction of an additional desulfurization facility. Therefore, the fuel oil and desulfurization agent emulsification method according to the present invention can be simply and easily applied to existing marine engines and has high desulfurization efficiency.

INDUSTRIAL APPLICABILITY

The present invention can be widely used for emulsification of fuel oil and a desulfurization agent.

The invention claimed is:

1. A method of emulsifying fuel oil and a desulfurization agent, the method comprising the steps of:

(a) supplying a desulfurization agent to fuel oil for line mixing thereof;

(b) generating droplets of the resulting mixture of step (a);

(c) magnetizing the mixture by causing the resulting mixture of step (b) to pass through a magnetic field;

(d) subjecting the magnetized mixture prepared in step (c) to vortex mixing; and (e) causing collision of the resulting mixture of step (d), wherein, in step (b), the mixture is passed through a droplet atomization unit provided with a plurality of fine holes to generate the droplets.

2. The method according to claim 1, wherein in step (a), the desulfurization agent is supplied in an amount of 3 to 10 parts by weight per 100 parts by weight of the fuel oil.

3. The method according to claim 1, wherein gas is additionally supplied in step (b).

4. The method of claim 3, wherein the gas is air or oxygen ($O_2$).

5. The method of claim 3, wherein the gas generates bubbles having sizes ranging from 1 to 500 μm in the fuel oil.

6. The method of claim 3, further comprising a step of separating the gas contained in the desulfurization agent and the fuel oil, the step being performed between step (d) and step (e).

7. The method according to claim 1, wherein in step (c), the magnetic field has a magnetic flux density of 9,000 to 15,000 gauss.

8. The method according to claim 1, wherein in step (c), the magnetic field is perpendicular to a fluid flow direction.

9. The method according to claim 1, wherein in step (e), the mixture collides at an angle of 15° with respect to an ejection direction of step (d).

* * * * *